US007685676B2

(12) United States Patent
Mc Clellan

(10) Patent No.: US 7,685,676 B2
(45) Date of Patent: Mar. 30, 2010

(54) LIVING HINGE

(76) Inventor: W. Thomas Mc Clellan, 2680 Arbor Dr., Fort Lauderdale, FL (US) 33312

( * ) Notice: Subject to any disclaimer, the term of this patent is extended or adjusted under 35 U.S.C. 154(b) by 0 days.

(21) Appl. No.: 11/361,569

(22) Filed: Feb. 24, 2006

(65) Prior Publication Data

US 2007/0199176 A1 Aug. 30, 2007

(51) Int. Cl.
*E05D 1/00* (2006.01)

(52) U.S. Cl. ..... 16/225; 16/221

(58) Field of Classification Search ..... 16/225–227, 16/372, 221, DIG. 13; 403/291, 403; 402/76, 402/77, 36; 220/4.21, 4.23, 836–839, 847; 215/235, 237

See application file for complete search history.

(56) References Cited

U.S. PATENT DOCUMENTS 3,572,957 A * 3/1971 Strassberg ..... 402/75
3,912,140 A * 10/1975 Franges ..... 294/166
3,937,389 A * 2/1976 Wind ..... 220/4.21
4,015,600 A * 4/1977 Liautaud ..... 604/177
4,023,239 A * 5/1977 Stolz ..... 24/33 P
4,115,902 A * 9/1978 Taylor ..... 16/221
4,185,934 A * 1/1980 Hodson ..... 402/80 L
4,192,620 A * 3/1980 Jahn ..... 402/15
4,212,094 A * 7/1980 Pray ..... 24/31 B
4,236,273 A 12/1980 Mc Caffrey
4,368,917 A * 1/1983 Urai ..... 297/452.54
4,619,304 A 10/1986 Smith
4,636,065 A * 1/1987 Kanemitsu et al. ..... 355/75
4,660,418 A 4/1987 Greenwood et al.
4,856,817 A * 8/1989 Moor ..... 281/29
5,028,075 A * 7/1991 Donnelly ..... 281/49
5,040,216 A * 8/1991 Policht ..... 281/46
5,067,624 A * 11/1991 Thanisch ..... 215/235
5,176,463 A * 1/1993 Kraus et al. ..... 403/265
5,267,686 A 12/1993 Gulliver et al.
5,386,918 A * 2/1995 Neveras et al. ..... 215/235
5,445,471 A * 8/1995 Wexler et al. ..... 403/220
5,494,185 A * 2/1996 Dubach ..... 220/838
5,538,132 A * 7/1996 Propp et al. ..... 206/365
5,893,585 A * 4/1999 Worthen ..... 281/45
6,005,209 A 12/1999 Burleson et al.
6,012,735 A * 1/2000 Gray et al. ..... 280/728.2
6,041,477 A * 3/2000 Rentsch et al. ..... 16/225
6,061,874 A * 5/2000 Tatara ..... 16/285
6,076,990 A * 6/2000 Jahn ..... 402/70
6,102,464 A * 8/2000 Schneider et al. ..... 296/37.3
6,140,006 A 10/2000 Komatsu et al.
6,230,428 B1 * 5/2001 Albin ..... 40/730
6,355,335 B1 3/2002 Kulkaski (Continued)

FOREIGN PATENT DOCUMENTS

GB 2360547 A * 9/2001

*Primary Examiner*—William L. Miller
(74) *Attorney, Agent, or Firm*—Laurence A. Greenberg; Werner H. Stemer; Ralph E. Locher

(57) ABSTRACT

A living hinge includes a hinge body formed of a material. The hinge body has attachment edges and a flexing zone between the attachment edges defining a flexing axis. The material of the hinge body has at least one separation formed therein in the flexing zone. The at least one separation describes an angle with the flexing axis being other than 90°.

13 Claims, 3 Drawing Sheets

U.S. PATENT DOCUMENTS 6,405,885 B1 * 6/2002 Elliott ..... 215/237
6,439,410 B1 * 8/2002 Dubach ..... 215/235
6,447,863 B1 * 9/2002 Lewin ..... 428/40.1
6,631,820 B2 * 10/2003 Harrold et al. ..... 215/237
7,021,022 B2 * 4/2006 Hearne ..... 52/715
2003/0098308 A1 * 5/2003 Cerone et al. ..... 220/315
2007/0137882 A1 * 6/2007 Journeaux et al. ..... 174/135

* cited by examiner

LIVING HINGE

BACKGROUND OF THE INVENTION

1. Field of the Invention

The invention relates to a living hinge. Such hinges are also known as live or flexible hinges in the art.

2. Description of the Related Art

Common articulating hinges are relatively complex, expensive, multipart devices with separate parts for rotating attachment edges about a pivot or axis. Living or live hinges are relatively simpler, lower-cost, one-piece flexing devices or functional hinges having of a flexing zone between attachment edges.

A living hinge of high strength requires the desirable qualities of toughness and stability found in metal or other high strength materials. However, those same properties of strength and rigidity limit their flexibility to be used as living hinges.

U.S. Pat. No. 6,355,335 to Kulkaski discloses a flexible hinge having a thin flexible web between two inflexible members. U.S. Pat. No. 4,619,304 to Smith teaches a hinged structure having S-shaped hinge members of resiliently flexible material passing partially around each other and tensioned around supports. Both the Kulkaski and Smith devices have extremely complicated, multipart configurations.

U.S. Pat. No. 4,236,273 to McCaffrey relates to a spring-like hinge in which a spring-like compressive force is applied to arcuate arms. The McCaffrey device relies upon the inherent flexibility of the material of the arms. However, that flexibility reduces and limits hinge strength and flexing cycle life.

U.S. Pat. No. 4,660,418 to Greenwood et al. discloses a flexible hinge in which a groove portion is etched away in a silicon body. The opposing surfaces of the hinge are placed alternately in destructive tension and compression, leading to low cycle life durability and high failure rates due to molecular disruption and fracture in the area of tension.

SUMMARY OF THE INVENTION

It is accordingly an object of the invention to provide a living hinge, which overcomes the hereinafore-mentioned disadvantages of the heretofore-known devices of this general type and which is simple, flexible and low-cost, yet has increased reliability, stability, strength and high cycle-life durability of metal or other suitable material.

With the foregoing and other objects in view there is provided, in accordance with the invention, a living hinge. The living hinge comprises a hinge body formed of a material. The hinge body has attachment edges and a flexing zone between the attachment edges defining a flexing axis. The material of the hinge body has at least one separation formed therein in the flexing zone. The at least one separation describes an angle with the flexing axis which is other than 90°. The hinge according to the invention converts the focused, destructive tension and compression of linear flexing, with its destructive molecular movements or forces at the surfaces, into non-destructive torsion or twisting movements that develop much smaller molecule to molecule movements.

In accordance with another feature of the invention, the at least one separation is a plurality of separations each describing the angle with the flexing axis. The plurality of separations are disposed in at least one row, preferably a plurality of rows, describing the angle with the flexing axis. The at least one row may be parallel or oblique to the flexing axis. The number and placement of separations and rows depends on the material and the application of the hinge.

In accordance with a further feature of the invention, the angle is at least substantially 30° and at most less than 90°. The angle may also be approximately 30° or approximately 45°.

In accordance with a concomitant feature of the invention, the at least one separation is a plurality of through cutouts, scorings, recesses, channels or laser cuts, which may be disposed in rows.

The angle and shape of the separations are also selected based on the intended use and material planned for the living hinge.

The living hinge according to the invention retains the simplicity, flexibility and low cost, of the prior art living hinge but, with the increased reliability, stability, strength and high cycle-life durability of metal or other suitable material. The living hinge of the invention overcomes the inherent problem of material rigidity by changing the manner in which flexing forces are absorbed. The new living hinge converts the focused, destructive tension and compression of linear flexing, which concentrates the destructive molecular movements or forces at the surfaces, into non-destructive torsion or twisting movements that develop much smaller molecule to molecule movements. It is equally important that these movements are evenly spread throughout the flexing element both vertically and longitudinally. In the prior art pliant material hinge a small area moves a lot, whereas in the semi-pliant material torsion hinge according to the invention, a large area moves a little.

This unique configuration of the machined or formed pliant material is constructed for the specific use of higher strength semi-pliant materials, such as metals or other suitable materials, in the manufacture of living hinges. Configuring the flexing or hinging zones into relatively long, narrow torsion elements allows this much stronger material to form an improved living hinge. The flexing area is separated into separate, active torsion hinging elements to improve flexibility, lengthen the flexing zone, reduce molecular strain and improve flexibility while improving the strength of living hinges.

Other features which are considered as characteristic for the invention are set forth in the appended claims.

Although the invention is illustrated and described herein as embodied in a living hinge, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figures 1A, 1B, 1C:
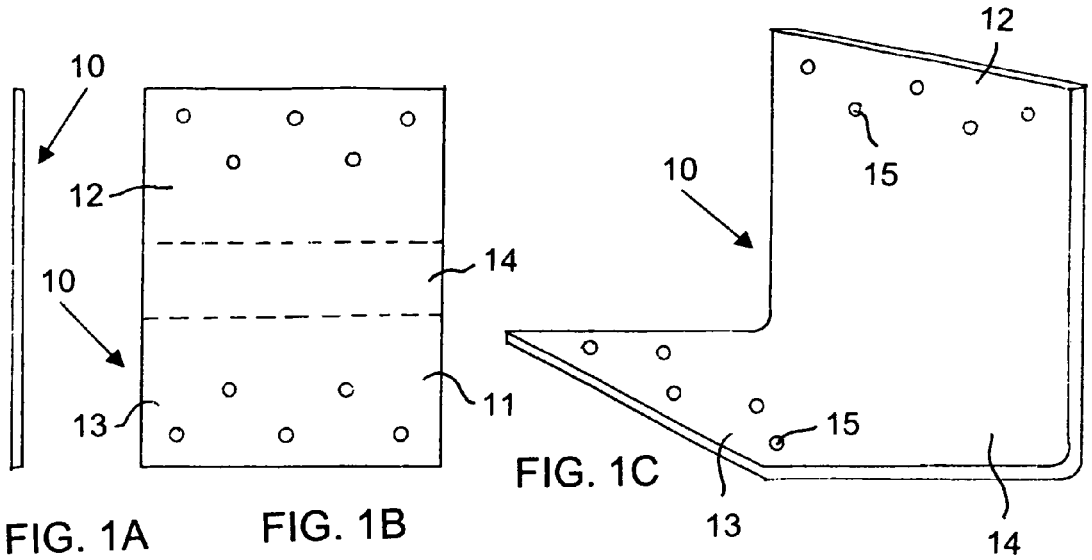
FIGS. 1A, 1B and 1C are respective diagrammatic, side-elevational, front-elevational and perspective views of a prior art living hinge.

Referring now to the figures of the drawings in detail and first, particularly, to FIGS. 1A, 1B and 1C thereof, there is seen a conventional living hinge 10 having attachment edges 12, 13 and a flexing zone 14 in a hinge body 11. The attachment edges 12, 13 have attachment holes 15 formed therein. The living hinge 10 is constructed of pliant materials having properties which tolerate the repeated tension and compression of opposing surfaces in the flexing zone 14, such as leather, rubber and some specific plastics, urethanes and polymers. Polypropylene is commonly used. This same pliability or softness necessary for flexibility, however reduces and limits the hinge strength and flexing cycle life.

Figures 2A, 2B, 2C:
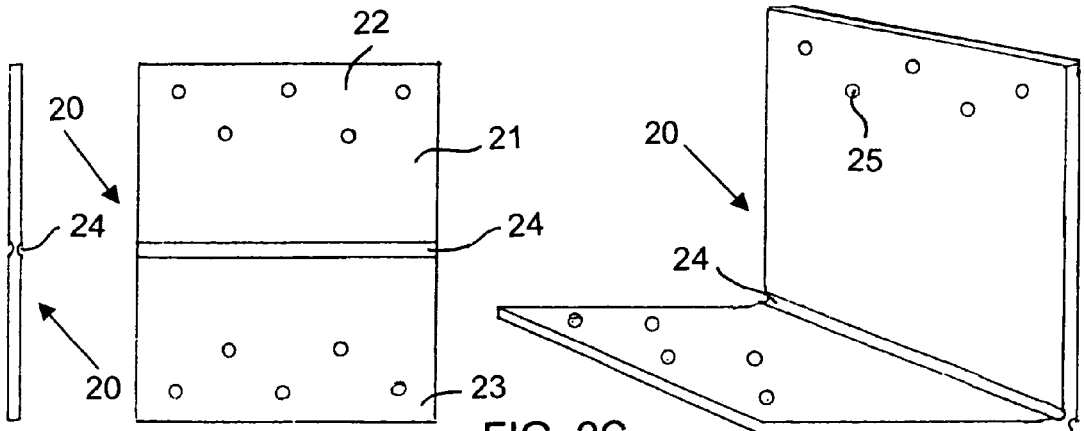
FIGS. 2A, 2B and 2C are respective side-elevational, front-elevational and perspective views of another prior are living hinge.

In another prior art living hinge 20 shown in FIGS. 2A, 2B and 2C, a flexing zone 24 is thinned, as compared to the flexing zone 14 of FIGS. 1A, 1B and 1C. The flexing zone 24 is formed in the material of a hinge body 21 of the living hinge 20. The flexing zone 24 may also be narrowed, lengthened or separated into one or more hinge elements, between attachment edges 22, 23 having attachment holes 25, in order to improve the flexing properties of the pliant material.

Figures 3A, 3B, 3C:
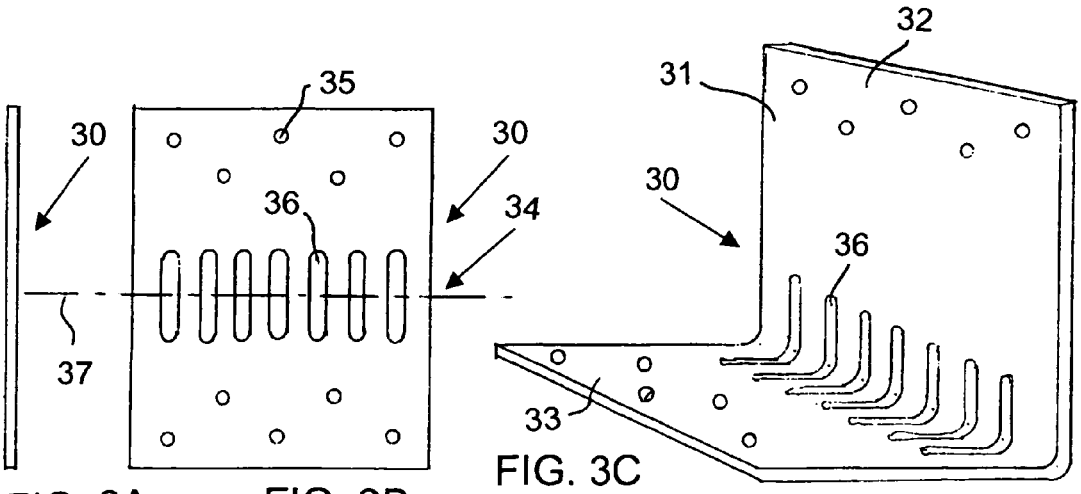
FIGS. 3A, 3B and 3C are respective side-elevational, front-elevational and perspective views of a further living hinge according to the prior art.

FIGS. 3A, 3B and 3C show a further living hinge 30 according to the prior art, in which a flexing zone 34 has cutouts or separations 36 that are cut or formed in the material of a hinge body 31 at right angles or other large angles (45 to 90 degrees) to a hinging or flexing axis 37, between two attachment edges 32, 33 having attachment holes 35. The opposing front and back surfaces of such prior art living hinges are still placed alternately in destructive tension and compression and therefore suffer low cycle life durability and high failure rates related to molecular disruption and fracture in the area of tension.

In all of the prior art living hinges, strength is sacrificed for flexibility.

Figures 4A, 4B, 4C:
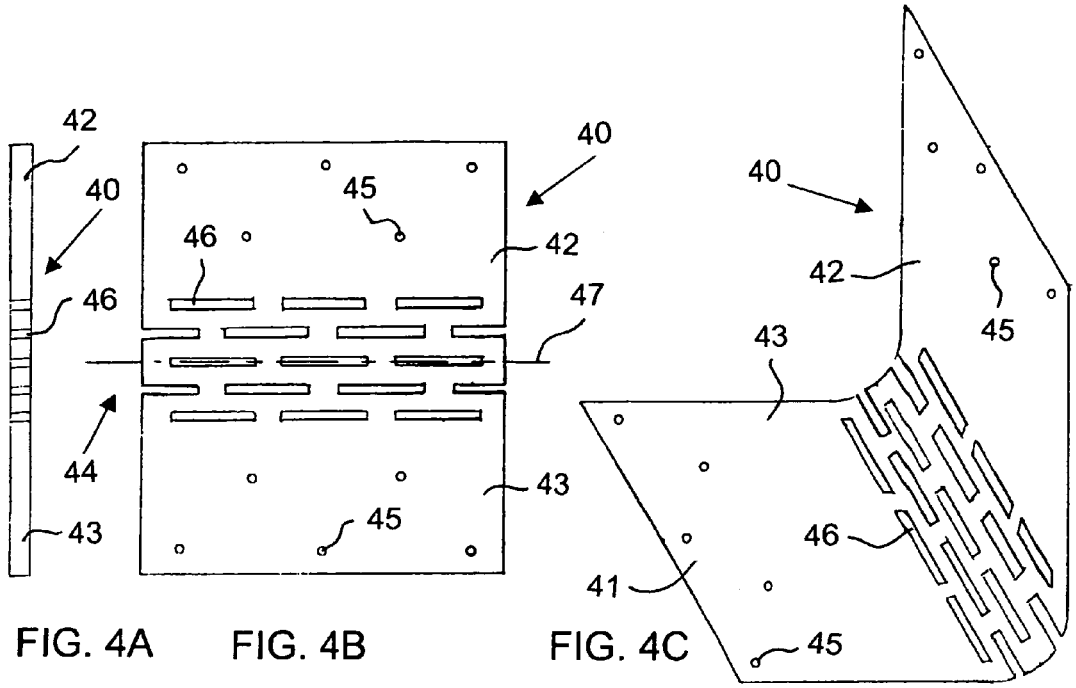
FIGS. 4A, 4B and 4C are respective side-elevational, front-elevational and perspective views of a first embodiment of a living hinge according to the invention.

In the first embodiment of the invention illustrated in FIGS. 4A, 4B and 4C, a living hinge 40 has attachment edges 42, 43 with attachment holes 45 formed therein. Through cutouts or separations 46 are formed or cut into the material of a hinge body 41 of the living hinge 40 in rows parallel to a hinging or flexing axis 47 at a flexing zone 44. The individual separations 46 of each row are offset relative to the individual separations 46 of adjacent rows. For example, the center of each individual separation 46 of one row may be aligned with a space between the individual separations 46 of the next row.

Figures 5A, 5B, 5C:
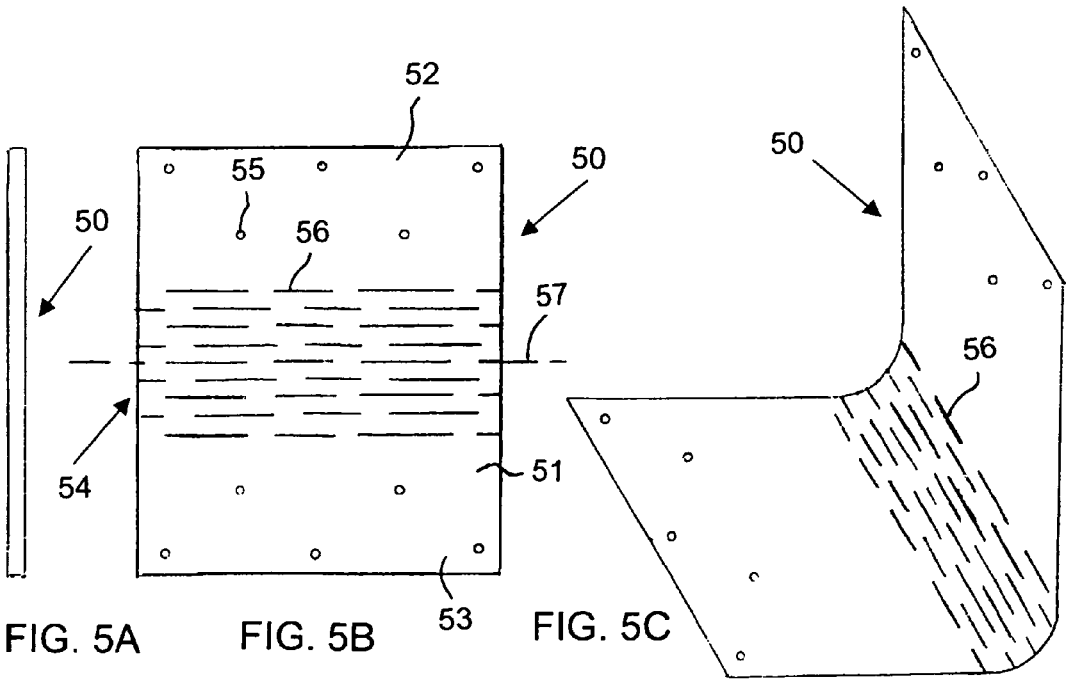
FIGS. 5A, 5B and 5C are respective side-elevational, front-elevational and perspective views of a second embodiment of the living hinge of the invention.

A living hinge 50, according to a second embodiment of the invention shown in FIGS. 5A, 5B and 5C, has recesses or separations 56 scored, scratched, laser-cut or dug into the surface of the material of a hinge body 51 of the living hinge between two attachment edges 52, 53 having attachment holes 55. The individual separations 56 in a flexing zone 54 are formed or cut in rows parallel to a hinging or flexing axis 57 and are mutually offset.

Figures 6A, 6B:
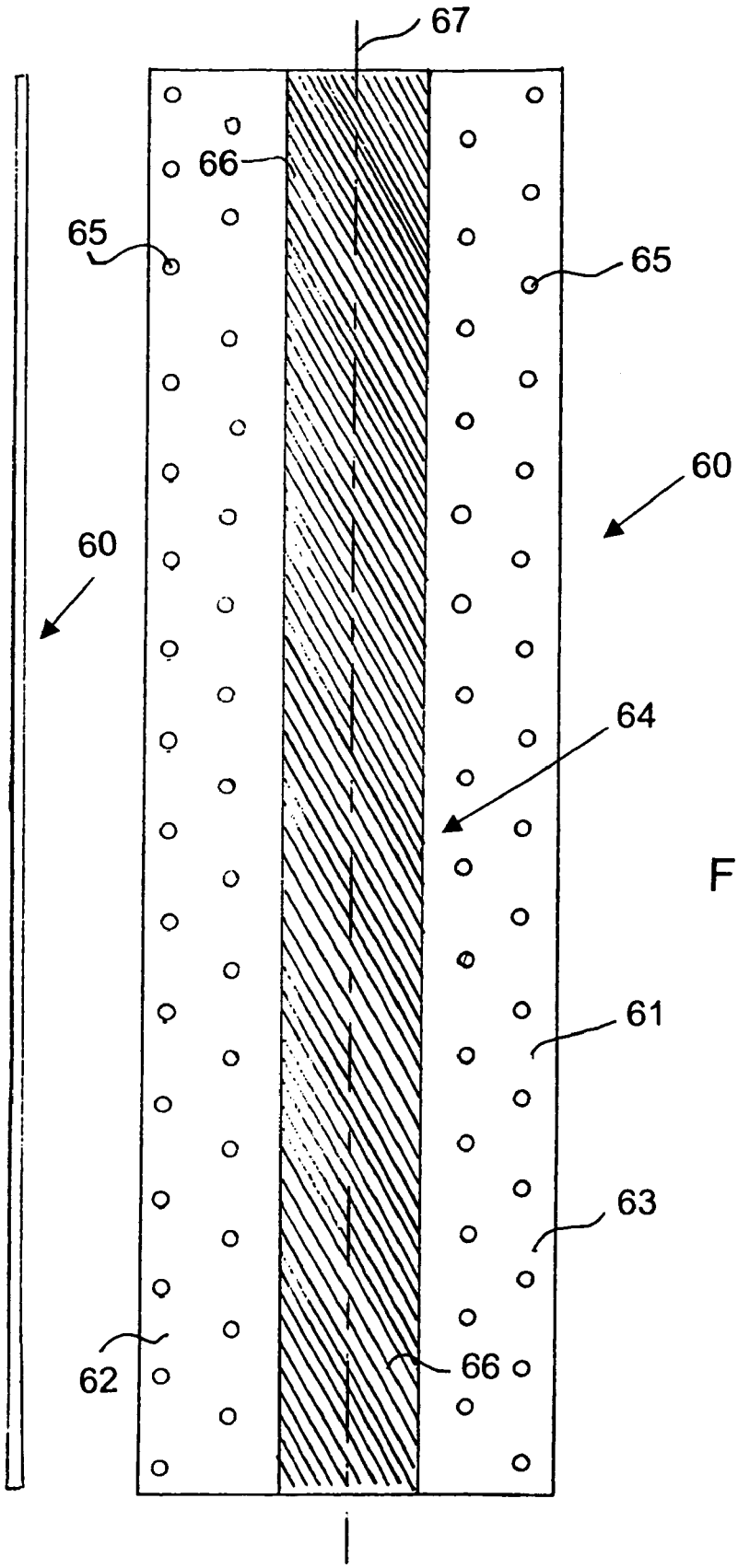
FIGS. 6A and 6B are respective side-elevational and front-elevational views of a third embodiment of the living hinge of the invention.

FIGS. 6A and 6B show a third embodiment of the invention, in which a living hinge 60 has attachment edges 62, 63 with attachment holes 65 formed therein. Recesses or separations 66 are scored, scratched, laser-cut or dug into the surface of the material of a hinge body 61 of the living hinge at an angle relative to a flexing axis 67 in a flexing zone 64. The angle may, for example, be 30 degrees, 45 degrees or any angle less than 90°.

It is noted that the desired effect may be accomplished with only one scoring or cutout or only one row of scorings or cutouts and that the scorings or cutouts are interchangeable in each of the embodiments of the inventions.

The angle (relative to the flexing axis), length, width, overlap and pattern of the separations, recesses or scores which are formed or cut within the material of the living hinge itself converts prior art tension and compression elements into improved function, torsion elements. These recesses, scores or separations are formed or cut parallel to or at small angles (0 to 45 degrees) relative to the hinging axis in FIGS. 4, 5 and 6. These overlapping hinging elements are alternately placed into minimally destructive, bidirectional, evenly dispersed torsion, creating a simple, low cost, strong, living hinge, which is greatly improved as compared to the prior art.

I claim:

1. A living hinge, comprising:

a one-piece hinge body formed of a semi-pliant material with a strength and rigidity providing limited flexibility;

said hinge body having attachment edges;

said hinge body having a flexing zone defining a flexing axis; and said material of said hinge body having at least two rows of individual separations formed therein in said flexing zone, said at least two rows of individual separations describing an angle with said flexing axis being other than 90°, said individual separations in each row being off-center from adjacent said individual separations in an adjacent row thereby defining overlaps lapping over and extending over part of said individual separations in said adjacent rows causing said hinge body of said material of limited flexibility to act as a living hinge body and purposefully produce torsion in said overlaps between said attachment edges in said flexing zone.

2. The living hinge according to claim 1, wherein said separations each describe said angle with said flexing axis.

3. The living hinge according to claim 2, wherein said angle is at least substantially 30° and at most less than 90°.

4. The living hinge according to claim 2, wherein said angle is approximately 30°.

5. The living hinge according to claim 2, wherein said angle is approximately 45°.

6. The living hinge according to claim 1, wherein said at least two rows are parallel to said flexing axis.

7. The living hinge according to claim 1, wherein said at least two rows are oblique to said flexing axis.

8. The living hinge according to claim 1, wherein said separations are through cutouts.

9. The living hinge according to claim 1, wherein said separations are scorings.

10. The living hinge according to claim 1, wherein said separations are recesses.

11. The living hinge according to claim 1, wherein said separations are channels.

12. The living hinge according to claim 1, wherein said separations are laser cuts.

13. The living hinge according to claim 1, wherein said material of said hinge body is a metal.

* * * * *